US006126527A

United States Patent [19]

Kao et al.

[11] Patent Number: 6,126,527

[45] Date of Patent: Oct. 3, 2000

[54] SEAL FOR POLISHING BELT CENTER SUPPORT HAVING A SINGLE MOVABLE SEALED CAVITY

[75] Inventors: Shu-Hsin Kao, Redwood City; William F. Lapson, Cupertino; Charles J. Regan, Moraga; David E. Weldon, Santa Clara, all of Calif.

[73] Assignee: Aplex Inc., Sunnyvale, Calif.

[21] Appl. No.: 09/113,540

[22] Filed: Jul. 10, 1998

[51] Int. Cl.[7] ..... B24B 21/00

[52] U.S. Cl. ..... 451/307; 451/299; 451/303

[58] Field of Search ..... 451/41, 59, 299; 303/307; 384/124

[56] References Cited

U.S. PATENT DOCUMENTS

| | | | |
|---|---|---|---|
| 4,420,162 | 12/1983 | Yannai et al. | 277/96.1 |
| 4,426,118 | 1/1984 | Moshin | 308/5 R |
| 4,542,994 | 9/1985 | Moshin | 384/101 |
| 5,114,244 | 5/1992 | Dunham et al. | 384/103 |
| 5,558,568 | 9/1996 | Talieh et al. | 451/303 |
| 5,579,718 | 12/1996 | Freerks | 118/733 |
| 5,593,344 | 1/1997 | Weldon et al. | 451/296 |
| 5,607,341 | 3/1997 | Leach | 451/41 |
| 5,681,215 | 10/1997 | Sherwood et al. | 451/388 |
| 5,738,568 | 4/1998 | Jurjevic et al. | 451/41 |
| 5,762,536 | 6/1998 | Pant et al. | 451/6 |
| 5,800,248 | 9/1998 | Pant et al. | 451/41 |
| 5,830,806 | 11/1998 | Hudson et al. | 438/690 |
| 5,916,012 | 6/1999 | Pant et al. | 451/41 |

*Primary Examiner*—Joseph J. Hail, III
*Assistant Examiner*—William Hong
*Attorney, Agent, or Firm*—Skjerven, Morrill, MacPherson, Franklin and Friel; Roberta P. Saxon

[57] ABSTRACT

A polishing tool uses a seal cavity containing a fluid that supports polishing pads against an object being polished. The boundaries of the cavity include a support structure, a portion of a polishing material, and a seal between the support structure and the polishing material. The polishing material moves relative to the support structure and seal. A variety of seal configurations can maintain the fluid within the cavity. In one embodiment the seal mechanism is a labyrinth seal including multiple ridges. In one embodiment, the seal mechanism is a face-sealing seal which includes a jacket with a u-shaped cross section with a compressible element positioned within it. The face-sealing seal is in a groove positioned outside of the cavity. Alternatively, the face-sealing seal forms the outer edge of the cavity. In a further embodiment, the seal is an o-ring seal positioned within a double dove-tailed groove.

28 Claims, 4 Drawing Sheets

SEAL FOR POLISHING BELT CENTER SUPPORT HAVING A SINGLE MOVABLE SEALED CAVITY

BACKGROUND

1. Field of the Invention

This invention relates to polishing systems and particularly to chemical mechanical polishing systems and methods using fluids to support a polishing pad.

2. Description of Related Art

Chemical mechanical polishing (CMP) in semiconductor processing removes the highest points from the surface of a wafer to polish the surface. CMP operations are performed on unprocessed and partially processed wafers. A typical unprocessed wafer is crystalline silicon or another semiconductor material that is formed into a nearly circular wafer. A typical processed or partially processed wafer when ready for polishing has a top layer of a dielectric material such as glass, silicon dioxide, or of a metal over one or more patterned layers that create local topological features on the order of about 1 $\mu$m in height on the wafer's surface. Polishing smoothes the local features so that ideally the surface of the wafer is flat or planarized over an area the size of a die formed on the wafer. Currently, polishing is sought that locally planarizes the wafer to a tolerance of about 0.3 m over the area of a die about 10 mm by 10 mm in size.

A conventional belt polisher includes a belt carrying polishing pads, a wafer carrier head which holds a wafer, and a support assembly that supports the portion of the belt under the wafer. For CMP, the polishing pads are sprayed with a slurry, and pulleys drive the belt. The carrier head brings the wafer into contact with the polishing pads so that the polishing pads slide against the surface of the wafer. Chemical action of the slurry and the mechanical action of the polishing pads and abrasives in the slurry against the surface of the wafer remove material from the wafer's surface. U.S. Pat. Nos. 5,593,344 and 5,558,568 describe CMP systems using hydrostatic fluid bearings to support a belt. Such hydrostatic fluid bearings have fluid inlets and outlets for fluid flows forming films that support the belt and polishing pads.

To polish a surface to the tolerance required in semiconductor processing, CMP systems generally attempt to apply a polishing pad to a wafer with a pressure that is uniform across the wafer. A difficulty can arise with hydrostatic fluid bearings because the supporting pressure of the fluid in such bearings tends to be higher near the inlets and lower near the outlets. Accordingly, such fluid bearings often apply a non-uniform pressure when supporting a belt and polishing pads, and the non-uniform pressure may introduce uneven removal of material during polishing. Methods and structures that provide uniform polishing are sought.

One solution to providing uniform polishing across a semiconductor wafer uses a sealed fluid chamber with a regulated pressure to support a compliant polishing material. As described in U.S. patent application Ser. No. 08/964,774, entitled "Polishing Tool Having a Sealed Fluid Chamber for Support of Polishing Pad," which is incorporated herein by reference, the sealed fluid chamber is part of the support assembly that supports the portion of the belt under the wafer. Fluid in the chamber is in direct contact with a moving belt that carries the polishing pads, and a seal between the fixed portion of the chamber and the belt prevents or reduces leakage from the chamber. The seal between the chamber and the belt plays an important role in imparting uniform pressure to the wafer in a polishing tool with a sealed fluid chamber support assembly. Seals that provide long life, easy maintenance, and low cost are desired.

SUMMARY

An embodiment of the invention provides sealing mechanisms for a fluid chamber of a support assembly in a polishing tool. The polishing tool includes a moving polishing belt, a wafer carrier head which presses a wafer against a polishing pad attached to the belt, and the support assembly on the opposite side of the belt from the wafer. The support assembly applies pressure to the back of the polishing belt to press the wafer against the polishing pad attached to the belt. The support assembly includes a support structure with a cavity that forms the sides and base of the fluid chamber. The moving belt forms the remaining side of the fluid chamber.

The sealing mechanisms of the present invention are at the interface between the support structure and the moving polishing belt and control fluid leakage from the chamber. A controlled sealing mechanism enables a predetermined pressure to be applied to a wafer in a polishing tool with a sealed fluid chamber support assembly. In one embodiment, the sealing mechanism is a labyrinth seal attached to the support structure. The labyrinth seal includes a plurality of ridges around an outer edge of the cavity. In operation, a certain amount of fluid leaks past the inner most ridge of the labyrinth seal to a depression between the first and second ridges. A lesser amount of fluid surmounts the second ridge to the area between the second and third ridges. The cumulative effect of the plurality of ridges is to control leakage from the fluid cavity. In one embodiment, the labyrinth seal is detachable from the support structure for easy replacement.

During polishing, an object such as a wafer being polished can tilt which causes a similar tilt in the polishing material. This tilting action interferes with controlled sealing of the fluid cavity using a labyrinth seal. To counteract this effect, support structures sealed with labyrinth seals are preferably mounted on actuators that control the orientation of the support structure to match the tilt in the polishing material.

In another embodiment, the sealing mechanism is a face-sealing seal set in a groove that surrounds the cavity in the support structure. The face-sealing seal includes a jacket containing a compressible element. In some embodiments, the compressible element is a spring. In other embodiments, the face-sealing seal additionally includes a flap of a plastic material over the jacket to prevent wear on the seal. Alternatively, the face-sealing seal is set at the outer edge of the fluid cavity.

The present invention also provides a standard o-ring seal set in a double dove-tailed groove as the sealing mechanism. The double dove-tailed groove is positioned outside the outer edge of the cavity. The shape of the double dove-tailed groove holds the o-ring in place during polishing. The sealing mechanisms of the present invention are also advantageously used in combination.

The present invention is better understood upon consideration of the detailed description below in conjunction with the accompanying drawings.

BRIEF DESCRIPTION OF THE DRAWINGS

Use of the same reference symbols in different figures indicates similar or identical items.

DETAILED DESCRIPTION OF THE PREFERRED EMBODIMENTS

A polishing tool uses a fluid chamber with a regulated pressure to support a compliant polishing material. The fluid is in contact with a back side of the compliant polishing material and is kept in the fluid chamber by seals which also contact the polishing material. In accordance with the invention, a variety of seal configurations effectively seal such fluid chambers.

Figure 1:
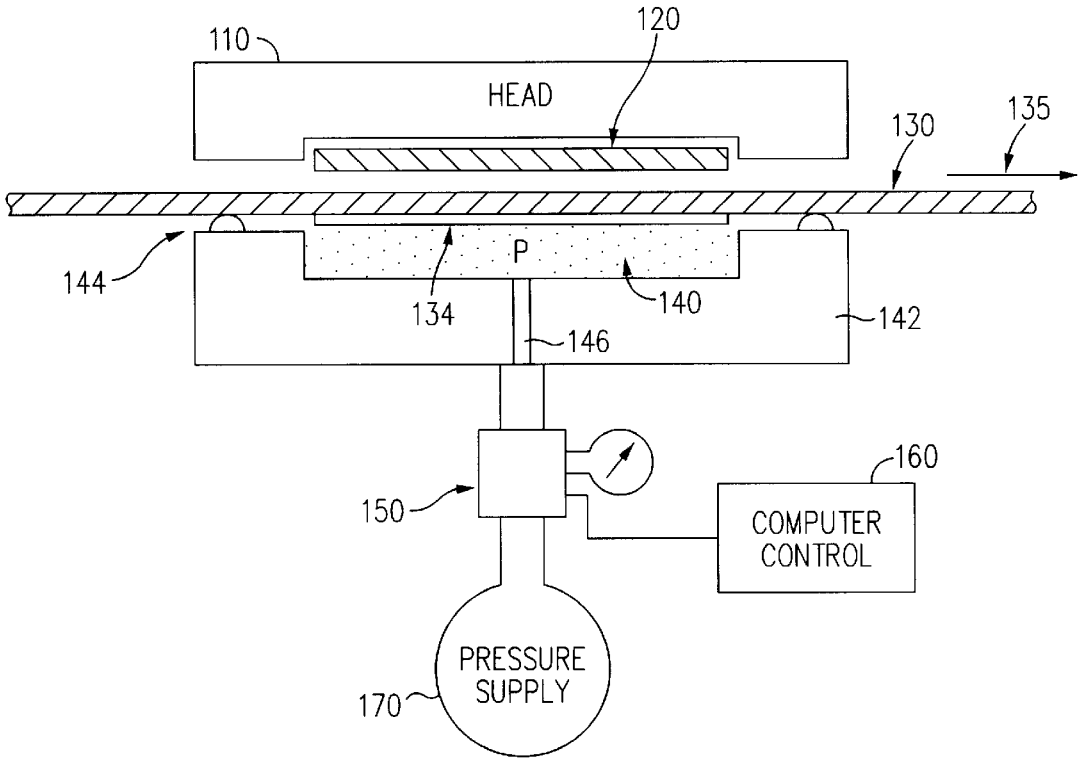
FIG. 1 shows a portion of a polishing tool that includes a sealed fluid chamber as part of a support assembly and schematically illustrates a sealing mechanism of the present invention.

FIG. 1 shows a polisher in which a carrier head 110 holds a wafer 120 in position against a compliant polishing material 130. Compliant polishing material 130 may include for example, an endless belt made of stainless steel on which polishing pads are mounted, the belt and pads having a width depending on the size of wafer 120. Under carrier head 110 and compliant material 130 is a fluid cavity 140 bounded by a support structure 142, a seal 144, and a portion 134 of compliant polishing material 130. The pressure of a fluid in cavity 140 (typically in the range between 0 and 60 psi) supports a portion 134 of compliant polishing material 130 that is directly under and in contact with wafer 120. Portion 134 is larger than the area of wafer 120 to reduce edge effects caused by the seals and to provide a more uniform polishing process.

The fluid in cavity 140 can be a liquid or a gas and is introduced to cavity 140 via an inlet/outlet 146 which is connected through a pressure regulator 150 to a pressure supply 170. The fluid in cavity 140 is preferably a liquid such as water if temperature control is desired for the polishing process. Temperature control of the fluid in fluid cavity 140 is described in the related U.S. patent application Ser. No. 09/113,450, entitled "Temperature Regulation in a CMP Process." A closed-loop controller 160 connected to regulator 150 selects a desired pressure for cavity 140 and pressure supply 170 selectably operates as either a fluid source or a fluid sink to maintain the selected pressure. The pressure field of the fluid chamber can be constant or varied temporally or spatially with different locations of inlet/outlet 146.

During polishing, polishing material 130 moves relative to support structure 142 and seal 144. For example, polishing material 130 moves in a direction 135 in FIG. 1. In addition, during polishing, carrier head 110 may sweep wafer 120 back and forth across polishing material 130 in a direction perpendicular to arrow 135. In an exemplary embodiment of the invention, support structure 142, which contains fluid cavity 140, moves back and forth across polishing material 130 in synchrony with the motion of carrier head 110 to maintain a constant set of conditions. Thus, fluid chamber 140 is a movable fluid chamber. Seal 144 is at the interface between support structure 142 and compliant polishing material 130 and controls fluid leakage from movable chamber 140. A reliable sealing mechanism enables a uniform pressure to be applied to wafer 120 in a polishing tool with a sealed fluid chamber support assembly. When there is controlled leakage between seal 144 and polishing material 130, a thin film of fluid forms over the seal which acts like a frictionless bearing to reduce the wear of the seal.

Figure 2A:
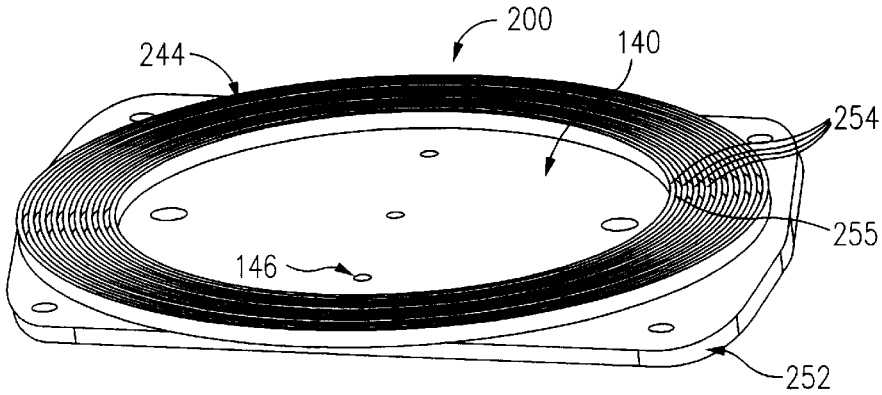
FIG. 2*a* shows a fluid cavity with a labyrinth sealing mechanism in accordance with the present invention.
Figure 2B:
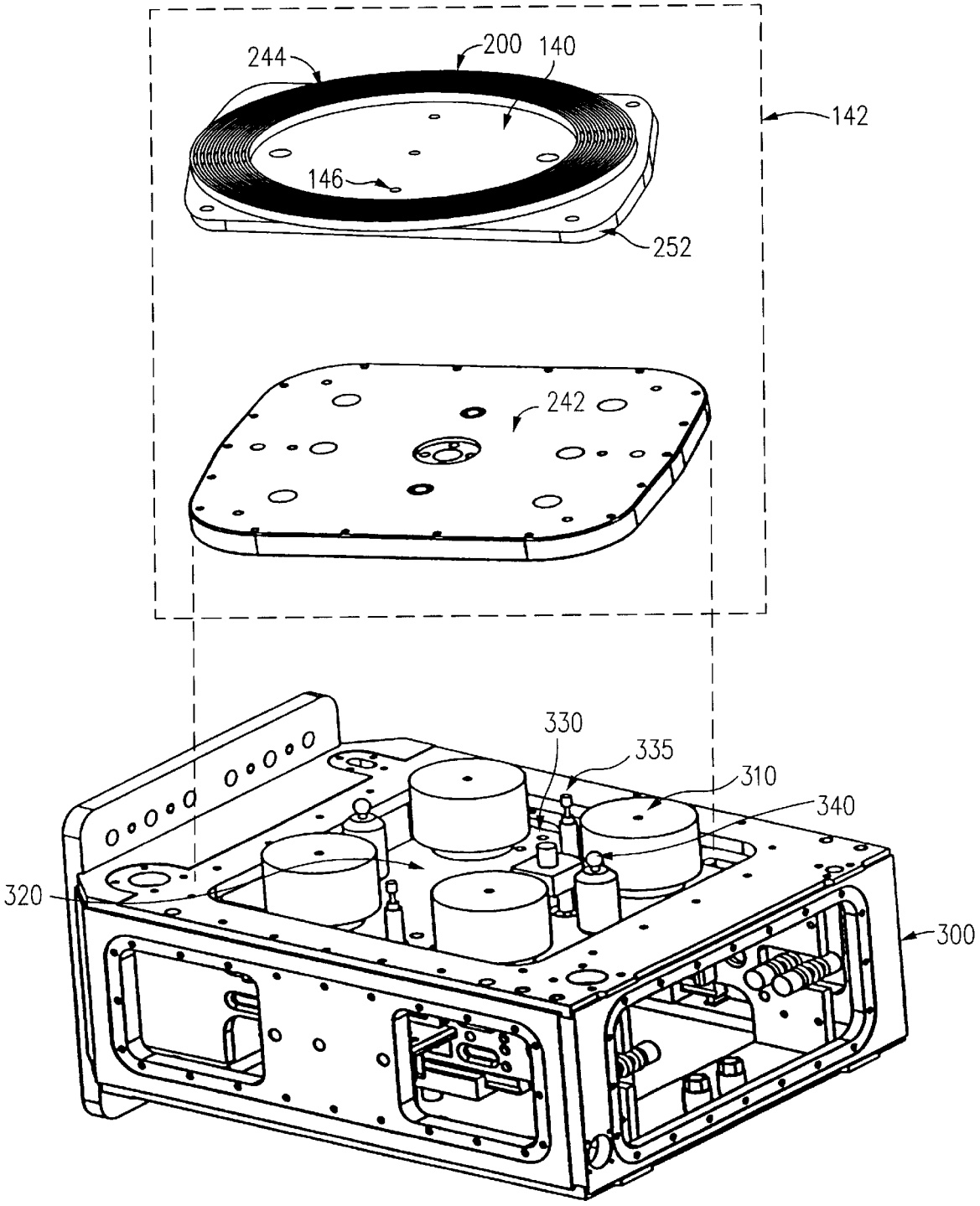
FIG. 2*b* shows an exploded perspective view of a fluid cavity with the labyrinth sealing mechanism mounted on a fixed support structure including actuators.

FIGS. 2*a* and 2*b* show a sealing mechanism 200 that advantageously seals cavity 140. Support structure 142 includes two elements: a rigid support structure plate 242, and a cavity plate 252 bounding fluid cavity 140, as shown in an exploded view in FIG. 2*b*. Seal 200 includes a labyrinth seal 244 positioned around cavity 140 proximate to cavity plate 252. As shown in FIG. 2*a*, cavity 140 is a depression in cavity plate 252. Labyrinth seal 244 includes a plurality of ridges 254, constructed of a plastic material that is chemically compatible with slurries used for polishing. For example, labyrinth seal 244 is constructed of an acetal resin such as Delrin AF®, provided by DuPont Corporation or Acetron NS™, from DSM Engineering Plastic Products. Alternatively, labyrinth seal 244 is constructed of Hydlar Z, a nylon/Kevlar® aramid composite supplied by A. L. Hyde Co. Support structure plate 242 is preferably constructed of metal, for example, stainless steel alloy 316SST-L that has been surface treated or aluminum 6061-T6.

In a polishing tool suitable for polishing 8-inch wafers, the labyrinth seal includes from 3 to 9 ridges 254, each being from about 0.04 to about 0.12 inches wide and spaced from about 0.04 to about 0.12 inches apart. The height of each ridge is about 0.08 inches. The specific width and separation of the ridges is varied according to the process application. For example, if the fluid in fluid chamber 140 is a gas, the ridges of the labyrinth seal are preferably about 0.04 inches wide and spaced 0.12 inches apart to enhance isothermal gas expansion to improve sealing. To seal liquid fluids in the fluid cavity, the ridges are preferably about 0.12 inches wide and spaced about 0.04 inches apart to enhance the surface tension effect.

In operation, i.e. when labyrinth seal 244 is pressed against compliant polishing material 130, a certain amount of fluid from cavity 140 leaks past the inner most ridge 254 of the labyrinth seal to a depression 255 between the first and second ridges 254. A lesser amount of fluid surmounts the second ridge to the area between the second and third ridges. The fluid pressure is highest between ridges near the cavity and gradually decreases toward the depressions between the outermost ridges. The cumulative effective of the plurality of ridges 254 is to control leakage from fluid cavity 140. In one embodiment, cavity plate 252 is made of the same material as labyrinth seal 244 and labyrinth seal 244 is attached to cavity plate 252. They may be fabricated such that labyrinth seal 244 and cavity plate 252 constitute a single structural element. Alternatively, labyrinth seal 244 is a detachable seal that may easily be replaced when worn out. In this embodiment, cavity plate 252 is preferably constructed of metal and the surface of cavity plate 252 includes a groove in which a detachable labyrinth seal 244 is positioned.

During polishing, wafer 120 can tilt from polishing frictional force, which causes a similar tilt in polishing material 130. This tilting action interferes with the controlled seal of fluid cavity 140 using a labyrinth seal. Controlled sealing of the fluid cavity is needed to maintain uniform supporting pressure against the compliant polishing material 130, which is desirable for uniform polishing. Support structure 142, using sealing mechanism 200, is preferably mounted in a polishing tool such that actuators control the orientation of the support structure. For example, support structure 142 may be mounted on a structure such as fixed support structure 300 shown in FIG. 2*b*. Fixed support structure 300 includes four air springs 310 attached to drive plate 320. Air springs 310 are used to tilt support structure 142 so that it remains parallel to wafer 120 as it tilts during polishing. Commercially available air springs, such as air spring model 1M1A-1 from the Firestone Company are used. A control circuit uses measurements from pressure sensor 330 to control air springs 310. Tooling balls 340 prevent support structure 142 from spinning due to frictional force of moving compliant material 130 and constrain the motion of support structure 142. The combination of tooling balls 340 and rigid support structure plate 242 provides a gimbal mechanism for support structure 142. Dampers 335 provide vibrational damping.

Figure 3:
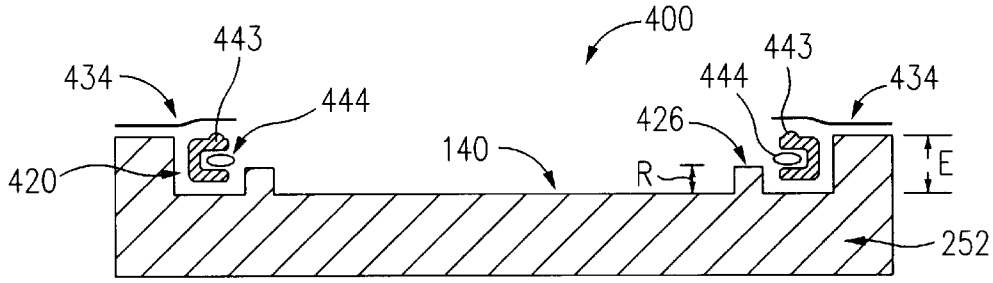
FIG. 3 shows a cross section of a fluid cavity with a face-sealing seal in accordance with other embodiments of the invention.

Another sealing mechanism 400, shown in FIG. 3, also can be used to seal fluid cavity 140. Sealing mechanism 400 is a face-sealing seal that includes a jacket 443 and a compressible element 444 inside the jacket. Jacket 443 has a u-shaped cross section as shown in FIG. 3, with the opening facing the interior of fluid cavity 140. Jacket 443 and compressible element 444 are positioned inside groove 420 which is located to the outside of the outer edge of fluid cavity 140. Ridge 426 separates groove 420 from fluid cavity 140. The height R of ridge 426 above fluid cavity 140 is preferably less than the height E of the outer edge of cavity plate 252, as shown in FIG. 3.

In one embodiment, compressible element 444 is an o-ring. In another embodiment, compressible element 444 is a continuous coil spring. Face-sealing seals, in general, and spring-loaded face-sealing seals, in particular, are commercially available, for example from BAL Seal Engineering Company. The BAL Seal spring-loaded face-sealing seal uses a spring with a canted coil as compressible element 444, as described, for example in U.S. Pat. No. 5,161,806. Jacket 443 is made of a plastic material that is chemically compatible with polishing slurries. Compressible element 444 can be made of any low durometer material or can be a metal spring. When the seal is spring loaded, that is when element 444 is a spring, sealing mechanism 400 can maintain uniform pressure in fluid cavity 140 when polishing material 130 tilts during polishing without need for actuators such as air springs 310. In an alternative embodiment, sealing mechanism 400 additionally includes a thin flap 434 positioned over jacket 443 to reduce wear on jacket 443. Flap 434 is preferably constructed of a high-wearing, low-friction polymer such as a reinforced polytetrafluoroethylene (PTFE).

Figure 4A:
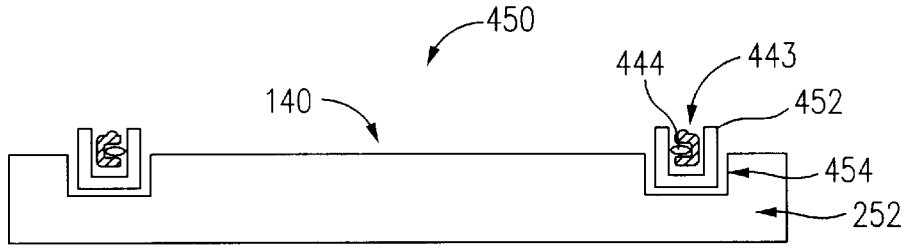
FIGS. 4*a* and 4*b* show additional face-sealing seal embodiments in accordance with the present invention.

In an additional embodiment, a face-sealing mechanism 450 in a two-part cavity plate is illustrated in FIG. 4*a*. In this embodiment, an additional element, seal holder 452 is positioned in a groove 454 in cavity plate 252. Jacket 443 and compressible element 444 are positioned inside seal holder 452. Seal holder 452 is preferably constructed of the same plastic materials as described for labyrinth seal 244. This embodiment advantageously provides a mechanism with low maintenance cost. Seal holder 452, as well as jacket 443 and compressible element 444, are easily replaced when worn out.

Figure 4B:
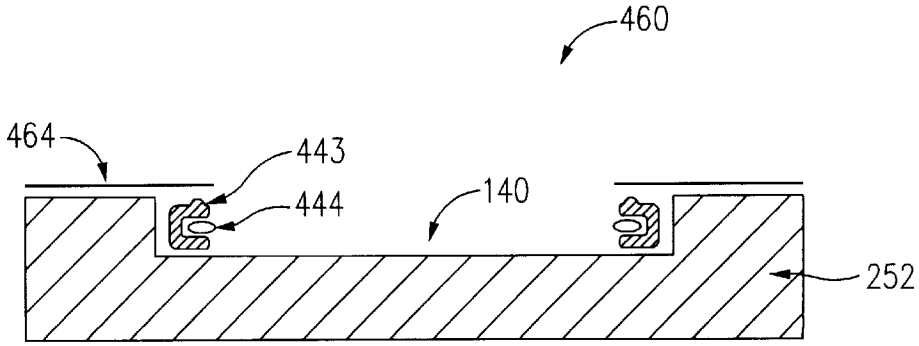
Figure 5A:
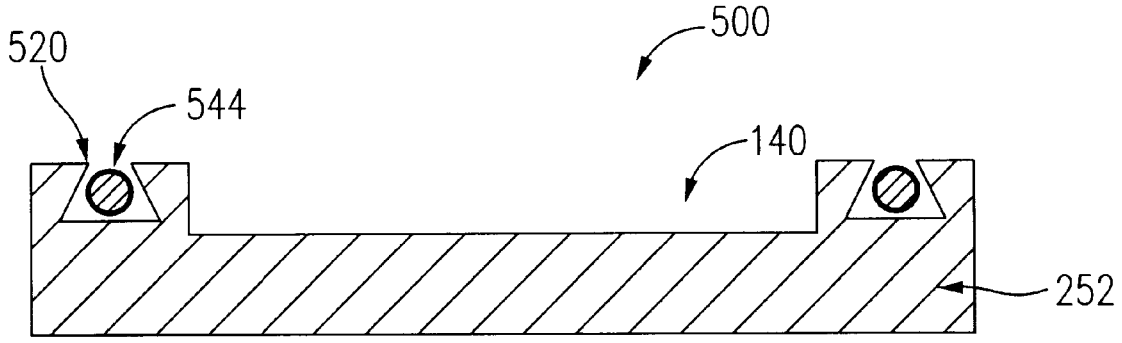
FIG. 5*a* shows a cross section of a fluid cavity with an o-ring in a double dove-tailed groove as the sealing mechanism in accordance with yet another embodiment of the invention.

A sealing mechanism 460, shown in FIG. 4*b*, is similar to seal 400 except that in sealing mechanism 460, jacket 443 and compressible element 444 are positioned at the outer edge of fluid cavity 140 instead of in a separate groove 420 as in sealing mechanism 400. In a further embodiment, sealing mechanism 460 additionally includes a flap 464 positioned over jacket 443 to reduce wear FIG. 5*a* shows a seal 500 that includes an o-ring 544 in a double dove-tailed groove 520 positioned outside fluid cavity 140. The shape of double dove-tailed groove 520 holds the o-ring in place when support structure 142 is pressed against compliant polishing material 130. The dove-tailed groove shape prevents the o-ring from rolling out of the groove due to the shear force of the o-ring and the polishing material during polishing. The o-ring can be made of a low durometer elastomeric material such as polypropylene, polyurethane, or polytetrafluoroethylene (PTFE). Sealing mechanism 500 can be used on a polishing tool that includes actuators to compensate for the tilt of polishing material, as described above for the labyrinth seal.

Figure 5B:
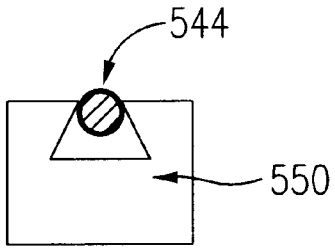
FIG. 5*b* shows a separate seal holder containing a double dove-tailed groove in accordance with another embodiment of the invention.

A double dove-tailed groove seal is alternatively used with a two-part cavity plate in an embodiment analogous to the face-sealing seal in the two-part cavity plate illustrated in FIG. 4*a*. In this case, seal holder 452 of FIG. 4*a* is replaced with seal holder 550, shown in FIG. 5*b*, which includes the double dove-tailed structure to hold o-ring 544 in place. Seal holder 550 and o-ring 544 are easily replaced for low cost maintenance.

To further control the sealing of the support cavity for particular applications, the sealing mechanisms of the present invention are also advantageously used in combination. For example, a labyrinth seal is used as the innermost seal and a face-sealing seal is positioned to encircle the labyrinth seal. Alternatively, the seals could be arranged in the opposite order, with a labyrinth seal encircling the face-sealing seal. In addition, an o-ring in a double dove-tailed groove can be positioned radially outward of the combination of a labyrinth seal and a face-sealing seal, arranged in either order.

Although the invention has been described with reference to particular embodiments, the description is only an example of the invention's application and should not be taken as a limitation. Various adaptations and combinations of features of the embodiments disclosed are within the scope of the invention as defined by the following claims.

We claim:

1. A support for a compliant polishing material in a polishing tool, comprising:

a support structure that includes a depression disposed adjacent the compliant material;

a seal that surrounds the depression, the seal comprising a plurality of ridges extending from the support structure to the compliant polishing material;

sensors that measure the relative orientation of the polishing material and the support structure;

actuators capable of adjusting the orientation of the support structure; and a control system coupled to the sensors and actuators, wherein pressure from a fluid enclosed in a cavity bounded by the depression, the seal, and a portion of the compliant polishing material supports the polishing material.

2. The support of claim 1, wherein the seal is detachable from the support structure.

3. The support of claim 1, wherein each ridge encircles the depression, and additional depressions separate the ridges.

4. The support of claim 1 wherein said actuators comprise a gimbal mechanism.

5. A support for a compliant polishing material in a polishing tool, comprising:

a support structure that includes a depression disposed adjacent the compliant material; and a seal that surrounds the depression, the seal comprising a jacket with a u-shaped cross section and a compressible element disposed inside the jacket, wherein pressure from a fluid enclosed in a cavity bounded by the depression, the seal, and a portion of the compliant polishing material supports the polishing material.

6. The support of claim 5, wherein the jacket is positioned in a groove in the support structure outside the cavity.

7. The support of claim 5, wherein the jacket is positioned at the outer edge of the cavity.

8. The support of claim 5, wherein the compressible element is a spring.

9. The support of claim 5 further comprising:

a groove in the support structure surrounding the depression; and a seal holder positioned in the groove, wherein the jacket is positioned in the seal holder and wherein the jacket and seal holder are easily replaced when worn.

10. The support of claim 5 further comprising a flap positioned over the jacket to prevent wear of the jacket during polishing.

11. The support of claim 5, further comprising:

sensors that measure the relative orientation of the polishing material and the support structure;

actuators capable of adjusting the orientation of the support structure; and a control system coupled to the sensors and actuators.

12. The support of claim 11 wherein said actuators comprise a gimbal mechanism.

13. A support for a compliant polishing material in a polishing tool, comprising:

a support structure that includes a depression disposed adjacent the compliant material;

a seal that surrounds the depression, the seal comprising a double dove-tailed groove and an o-ring disposed inside the double dove-tailed groove;

sensors that measure the relative orientation of the polishing material and the support structure;

actuators capable of adjusting the orientation of the support structure; and a control system coupled to the sensors and actuators, wherein pressure from a fluid enclosed in a cavity bounded by the depression, the seal, and a portion of the compliant polishing material supports the polishing material.

14. The support of claim 13 wherein said actuator comprise a gimbal mechanism.

15. A belt polishing apparatus, comprising:

a belt of compliant polishing material;

a support structure that includes a depression disposed adjacent the compliant material;

a seal that surrounds the depression, the seal comprising a plurality of ridges extending from the support structure to the compliant polishing material;

sensors that measure the relative orientation of the polishing material and the support structure;

actuators capable of adjusting the orientation of the support structure; and a control system coupled to the sensors and actuators, wherein pressure from a fluid enclosed in a cavity bounded by the depression, the seal, and a portion of the compliant polishing material supports the polishing material.

16. The apparatus of claim 15, wherein the seal is detachable from the support structure.

17. The apparatus of claim 15 wherein said actuators comprise a gimbal mechanism.

18. A belt polishing apparatus, comprising:

a belt of compliant polishing material;

a support structure that includes a depression disposed adjacent the compliant material; and a seal that surrounds the depression, the seal comprising a jacket with a unshaped cross section and a compressible element disposed inside the jacket, wherein pressure from a fluid enclosed in a cavity bounded by the depression, the seal, and a portion of the compliant polishing material supports the polishing material.

19. The apparatus of claim 18, wherein the jacket is positioned in a groove in the support structure outside the cavity.

20. The apparatus of claim 18, wherein the jacket is positioned at the outer edge of the cavity.

21. The apparatus of claim 18, wherein the compressible element is a spring.

22. The apparatus of claim 18 further comprising:

a groove in the support structure surrounding the depression; and a seal holder positioned in the groove, wherein the jacket is positioned in the seal holder and wherein the jacket and seal holder are easily replaced when worn.

23. The apparatus of claim 18 further comprising a flap positioned over the jacket to prevent wear of the jacket during polishing.

24. The apparatus of claim 18, further comprising:

sensors that measure the relative orientation of the polishing material and the support structure;

actuators capable of adjusting the orientation of the support structure; and a control system coupled to the sensors and actuators.

25. A belt polishing apparatus, comprising:

a belt of compliant polishing material;

a support structure that includes a depression disposed adjacent the compliant material;

a seal that surrounds the depression, the seal comprising a double dove-tailed groove and an o-ring disposed inside the double dove-tailed groove;

sensors that measure the relative orientation of the polishing material and the support structure;

actuators capable of adjusting the orientation of the support structure; and a control system coupled to the sensors and actuators, wherein pressure from a fluid enclosed in a cavity bounded by the depression, the seal, and a portion of the compliant polishing material supports the polishing material.

26. A method for polishing an object, comprising:

placing the object in contact with a polishing material;

supporting the polishing material using a support structure that includes a depression disposed adjacent the compliant material and a seal that surrounds the depression, the seal comprising a plurality of ridges extending from the support structure to the polishing material;

moving the polishing material relative to the object while the support structure support the polishing material; and adjusting the orientation of the support structure using actuators, whereby the orientation of the support structure matches the orientation of the object being polished.

27. A method for polishing an object, comprising:

placing the object in contact with a polishing material;

supporting the polishing material using a support structure that includes a depression disposed adjacent the compliant material and a seal that surrounds the depression, the seal comprising a jacket with a u-shaped cross section and a compressible element disposed inside the jacket; and moving the polishing material relative to the object while the support structure supports the polishing material.

28. A method for polishing an object, comprising:

placing the object in contact with a polishing material;

supporting the polishing material using a support structure that includes a depression disposed adjacent the compliant material and a seal that surrounds the depression, the seal comprising a double dove-tailed groove and an o-ring disposed inside the double dove-tailed groove;

moving the polishing material relative to the object while the support structure supports the polishing material; and adjusting the orientation of the support structure using actuators, whereby the orientation of the support structure matches the orientation of the object being polished.

* * * * *